United States Patent [19]

Filho

[11] Patent Number: 4,993,347

[45] Date of Patent: Feb. 19, 1991

[54] OFFSHORE HARBOR

[75] Inventor: Floréncio d. O. Filho, Curitiba, Brazil

[73] Assignee: Petroleo Brasileiro S.A. - Petrobras, Rio de Janeiro, Brazil

[21] Appl. No.: 463,797

[22] Filed: Jan. 8, 1990

Related U.S. Application Data

[63] Continuation of Ser. No. 139,229, Dec. 29, 1987, abandoned.

[30] Foreign Application Priority Data

Dec. 29, 1986 [BR] Brazil ..... PI8606465

[51] Int. Cl.[5] ..... E02B 17/00

[52] U.S. Cl. ..... 114/258; 405/195; 405/224

[58] Field of Search ..... 114/263–267, 114/258, 261; 405/195, 21, 31, 203–209, 107, 110, 112, 224–228

[56] References Cited

U.S. PATENT DOCUMENTS

| | | | |
|---|---|---|---|
| 1,341,677 | 6/1920 | Roberts | 114/261 |
| 1,896,546 | 2/1933 | Kulik | 114/261 |
| 2,374,938 | 5/1945 | Hundley | 114/258 |
| 3,165,898 | 1/1965 | Elliott | 114/261 |
| 3,287,921 | 11/1966 | Wilson | 405/3 |
| 3,626,447 | 12/1971 | Hindlin | 405/221 |
| 4,064,700 | 12/1987 | Sameshima | 405/30 |
| 4,481,899 | 11/1984 | Einstabland | 114/261 |
| 4,640,214 | 2/1987 | Bruns | 405/219 |
| 4,642,000 | 2/1987 | Lin | 405/221 |
| 4,799,828 | 1/1989 | Georeii | 114/265 |

FOREIGN PATENT DOCUMENTS

| | | | |
|---|---|---|---|
| 209196 | 5/1960 | Fed. Rep. of Germany | 405/221 |

*Primary Examiner*—Joseph F. Peters, Jr.
*Assistant Examiner*—Clifford T. Bartz
*Attorney, Agent, or Firm*—Sughrue, Mion, Zinn, Macpeak & Seas

[57] ABSTRACT

An offshore harbor including a first support structure firmly fixed to the sea bed, a first flat slab supported by the first support structure, and a plurality of vertical sidewalls resting on the first slab and being joined together to form a hollow shell which defines an inside portion. The inside portion of the shell houses a portion of the sea, and one of the plurality of vertical sidewalls is provided with an opening so that the inside portion of the hollow shell is in communication with the rest of the sea through the opening. The offshore harbor further includes an assembly of blocks disposed on the first flat slab between an edge thereof and one of the vertical sidewalls. The assembly of blocks includes a plurality of horizontal layers stacked upon each other to form a staircase configuration.

10 Claims, 2 Drawing Sheets

OFFSHORE HARBOR

This is a continuation of application Ser. No. 07/139,229 filed 12/29/87, now abandoned.

FIELD OF THE INVENTION

This invention relates to structures which are to be installed in the sea to act as a safe anchorage for boats that provide supporting services for work being done at places offshore, in the ocean, and also as a base for auxiliary facilities, and because of their large size, such structures have also been specially designed to provide the boats sheltering therein with a safe protection against rough seas, ocean currents, wind, etc.

BACKGROUND OF THE INVENTION

A large part of the ideas upon which this invention has been based has been described in Brazilian application No. PI 8606370 for an IP (Invention Privilege) of Dec. 22, 1986, which IP corresponds to pending U.S. application Ser. No. 07/136,324 filed on Dec. 22, 1987, and lodged by the same Applicant, and which is included herein by reference thereto, though some of the aspects that make up this present invention are quite different from those in the aforesaid former application, which fact warrants the originality hereof, and its main advantages lie in such aspects.

SUMMARY OF THE INVENTION

In principle the description of this invention is that of a facility quite like that of the Floating Offshore Support Facility described in the application for a Privilege mentioned by reference, though it is a structure that is fixed to the bottom of the sea by means of rigid supporting devices (as, for instance, structural legs made of metal or concrete), and is therefore better equipped to withstand rough seas and ocean currents.

Also, since the whole of the facility is fixed to the bottom of the sea, thereby doing away with the need for any flexible mooring lines, the structure covered by this invention can afford greater protection, so much so that the walls of the shell that protects the enclosed part in which boats will lie sheltered, may be quite thin as compared with those that have been described in the aforesaid reference, thereby providing at the same time a greater degree of safety by rendering the sea calm within the aforesaid shell.

In order that all the advantages and all the major purposes of this invention may be promptly and clearly understood, reference will be made to the figures attached hereto which are of a preferred version of this invention, but it must be clearly realized that various other variations covered by the scope and the intention of this invention are included. Thus FIG. 1 is a view in perspective of the offshore harbour as in this invention, plus a landing strip attached to it. FIG. 2 is a side section of a plan view according to plane A—A of FIG. 1.

DESCRIPTION OF THE PREFERRED EMBODIMENT

Figure 1:
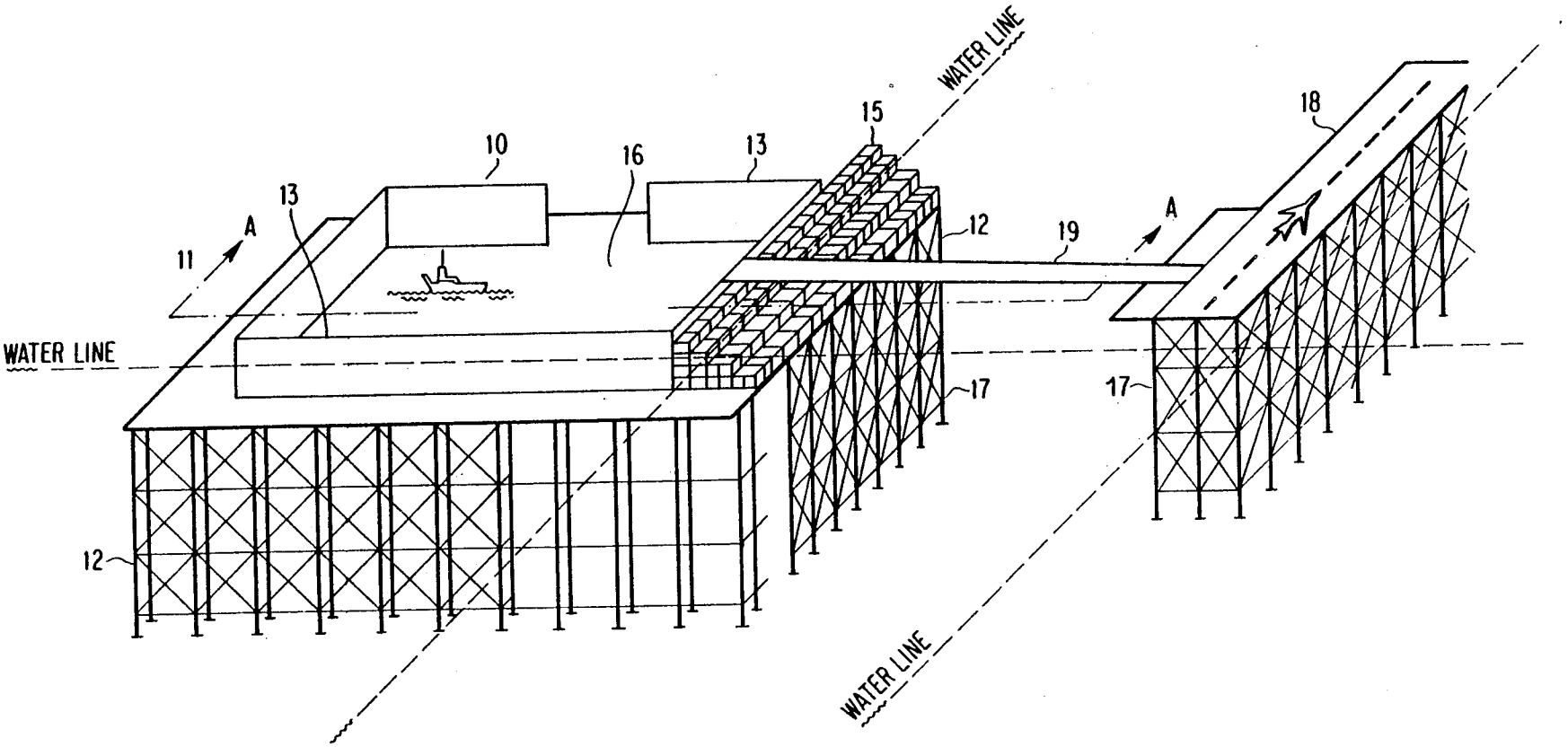

Referring to FIG. 1, it is seen that the floating harbour 10 consists of a slab 11 resting on supporting legs 12 which in turn are firmly fixed to the bottom of the sea.

Upon such slab 11 and making up one of the most important parts of this invention herewith submitted, rests the enclosing shell formed by the side walls 13, which shell in this example appears as a bulkhead that, looked at from above, is in the shape of a square. It should be added that slab 11 is shown as a hollow square, in such a way that the walls 13 of the shell, hereinafter referred to as just the "frame", rest practically upon the inside edges of the square opening which is the hollow space 16 of the slab.

As is to be seen from FIG. 1, on at least one of the sides of the slab 11, resting laterally upon the outside side wall of the frame, there is a barrier 15 against the action of the waves, which in actual fact acts like a breakwater, and is created by piling up cubic pieces (as if they were bricks), and their piled up arrangement is such that every layer has more pieces than the next layer up but less than the next layer down, so that the final arrangement of the "breakwater" is like the tiers of seats in a football stadium. However, it should be added that the width of each layer like that of the slab 11 on which it rests is the same size as the wall 13 of the frame against which it rests. This overlying arrangement of the layers that make up the "breakwater" is easy to picture from the section view thereof in FIG. 2.

In the past there have been several kinds of "breakwater" designs, most of them intended to protect harbours or places close to the shore, the damping effect thereof being largely due to the design of the pieces massed together to create the bulkhead and in many cases to the way in which such bulkheads are fixed to the sea bottom.

To quote an instance, there is that under U.S. Pat. No. 4,064,700 granted on Dec. 27, 1977 to Japan Port Consultants Ltd., which is hereby referred to. Though the profile of such patent is a stepped one its design depends principally on the supporting masonry and stiffening struts directly fixed to the sea bottom, in such a way that the parts which hold up the struts are what chiefly enable the whole structure to stand up to the action of the waves. This patent was intended for relatively low structures in the region of 15 meters high.

Figure 2:
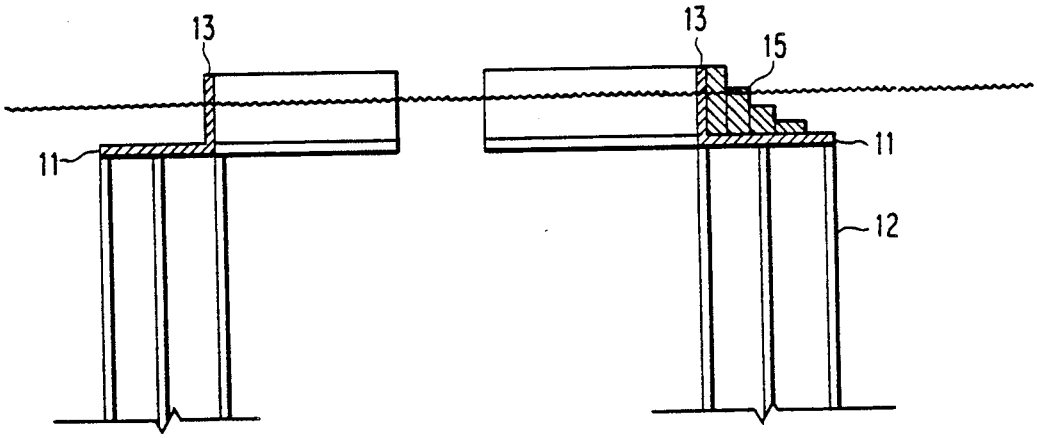

But in this invention the frame style structure and solid support provided by beam 11 are what keep up this much longer and heavier facility which is this "breakwater" or "beach" arrangement 15 shown in FIGS. 1 and 2, where no kind of stiffening struts or supporting masonry is called for. Because of the weight and the length of the arrangement of cubic parts covered by this invention, along with the other aspects of the harbour structure, there can be a beach up to 50 meters under water, which was not provided for in the former designs.

Still with reference to FIG. 1, it will be noticed that the "frame" has a break in one of its walls 13, which is an opening connecting the inside 16 of the harbour with the open sea. It should also be noted that such opening is preferably in the "frame" wall that stands at right angles to the wall against which the "breakwater" rests, which we shall refer to hereinafter as the "beach", as it is called in hydraulics.

Since it is a facility that has to deal with very heavy material that is to be firmly installed upon supports fixed to the sea bed the offshore harbour of this invention is meant, in principle, for places where the depth of water is from 70 to 150 meters.

As for the size and structural arrangement of the legs 12 that are to hold up the slab 11, and therefore the whole harbour, this is a point which will depend on each individual case and the way to design such sustaining structures is more than well known to engineers and this invention does not concern any given design thereof, it being merely required that the design chosen be able to provide reliable support for the whole of the facility.

As regards the depth to which the slab 11 and the submerged part of the walls 13 of the "frame" lie under water, the same parameters are employed here as applied in the case of the "frame" described under the Offshore Floating Support Facility described and claimed under Brazilian Patent application No. PI 8606370 of Dec. 22, 1986, lodged by the Applicant, here mentioned for the purpose of reference. Thus it has already been worked out empirically and laid down as data in the designing of structures subjected to rough seas, that the bulkhead should be submerged (so that the force of waves may be safely lessened after striking such bulkhead) to a depth in the region of thirty to fifty meters. Therefore the slab should be submerged to a depth of at least 30 meters below the surface of the sea and this should also be the height of the walls of the "frame" which is submerged in the sea, while the part which is out of the water will depend on other design features which are beyond the scope of this invention.

Another point to consider is the thickness of the wall of the "frame". In the case in point, as opposed to the Floating Structure covered by the Invention Application referred to, no strict figure is laid down as the minimum thickness for the walls of the "frame" since this invention covers the design of a "beach" which in itself is already enough to bring about the required deadening of the force of the waves. Therefore the frame may be built with cement walls quite a lot thinner than the 20 meters specified for the previous invention referred to herein.

In view of the stability and convenience provided by these facilities under this invention, a further feature is added hereto, namely, the building of a landing strip 18 for small planes, attached to the harbour described above, however not sharing the structure of the latter as a base for it, but rather resting on its own supporting system 17, though joined to the main harbour structure by means of a bridge 19, as shown schematically, in very general lines (just to provide those conversant with the subject), in FIG. 1. However, for the sake of safety and to ensure the proper operation thereof it is hereby agreed upon that the strip 18 for a harbour of the design shown herein, should stand at least 20 meters above the surface of the sea.

As for any of the other facilities that may be installed upon the offshore harbour structure described herein, these will be the same as installed in the Floating Structure referred to covered under the invention of Brazilian application No. PI 8606370 of Dec. 22, 1986, lodged by the same Applicant as the present one.

Anyway the version of the invention herewith submitted should be regarded as one of the possible versions thereof, and invention should not be limited thereby, since various variations of it may be conceived without departing from the scope and idea of the invention, which is to be limited merely by the claims attached hereto.

I claim:

1. An offshore harbour, comprising:

a first support structure firmly fixed to the sea bed;

a first flat slab supported by said first support structure, said first flat slab being submerged below the surface of the sea;

a plurality of vertical side walls resting on said first slab and being joined together to form a hollow shell which defines an inside portion, the inside portion of the shell housing a portion of the sea, and one of said plurality of vertical side walls being provided with an opening so that the inside portion of the hollow shell is in communication with the rest of the sea through the opening; and an assembly of blocks disposed on said first flat slab between an edge thereof and one of said vertical side walls, said assembly of blocks comprising a plurality of horizontal layers stacked upon each other to form a staircase configuration.

2. The offshore harbour according to claim 1, wherein said first flat slab is submerged between thirty and fifty meters below the surface of the sea.

3. The offshore harbour according to claim 1, wherein each of said blocks of said assembly is cubic.

4. The offshore harbour according to claim 1, wherein said first flat slab has a square shape.

5. The offshore harbour according to claim 1, wherein said support structure comprises a plurality of metal columns.

6. The offshore harbour according to claim 1, wherein said support structure comprises a plurality of concrete columns.

7. The offshore harbour according to claim 1, wherein said plurality of vertical side walls are each made of concrete.

8. The offshore harbour according to claim 1, wherein each of the stacked horizontal layers of said assembly of blocks comprises a plurality of blocks, and wherein at least one of the horizontal layers has more blocks than the number of blocks of the horizontal layer stacked directly upon the at least one of the horizontal layers.

9. An offshore harbour, comprising:

a first support structure firmly fixed to the sea bed;

a first flat slab supported by said first support structure;

a plurality of vertical side walls resting on said first slab and being joined together to form a hollow shell which defines an inside portion, the inside portion of the shell housing a portion of the sea, and one of said plurality of vertical side walls being provided with an opening so that the inside portion of the hollow shell is in communication with the rest of the sea through the opening;

an assembly of blocks disposed on said first flat slab between an edge thereof and one of said vertical side walls, said assembly of blocks comprising a plurality of horizontal layers stacked upon each other to form a staircase configuration;

a second support structure firmly fixed to the sea bed;

a second flat slab supported by said second support structure and disposed above the surface of the sea; and a bridge connecting the second flat slab and said one of said side walls.

10. The offshore harbour according to claim 9, wherein said second flat slab has a length sufficient to serve as a landing strip for airplanes.

* * * * *